US006719212B1

(12) United States Patent
Leisi

(10) Patent No.: US 6,719,212 B1
(45) Date of Patent: Apr. 13, 2004

(54) SPRAY HEAD

(76) Inventor: Marcel Leisi, 26B, avenue Tronchet, CH-1226 Thonex (CH)

( * ) Notice: Subject to any disclaimer, the term of this patent is extended or adjusted under 35 U.S.C. 154(b) by 0 days.

(21) Appl. No.: 09/646,439

(22) PCT Filed: Mar. 17, 1998

(86) PCT No.: PCT/CH98/00104

§ 371 (c)(1),
(2), (4) Date: Nov. 15, 2000

(87) PCT Pub. No.: WO99/47274

PCT Pub. Date: Sep. 23, 1999

(51) Int. Cl.[7] ..... B05B 15/02
(52) U.S. Cl. ..... 239/119; 239/600
(58) Field of Search ..... 239/119, 600; 251/315.08, 315.09, 315.12, 315.16, 118, 120

(56) References Cited

U.S. PATENT DOCUMENTS

| | | | | | |
|---|---|---|---|---|---|
| 3,528,611 | A | * | 9/1970 | Watson | 137/584 |
| 3,667,681 | A | * | 6/1972 | Blancha | 239/119 |
| 3,952,955 | A | | 4/1976 | Clements | 239/288 |
| 3,955,763 | A | * | 5/1976 | Pyle et al. | 923/119 |
| 4,116,386 | A | * | 9/1978 | Calder | 239/119 |
| 4,165,836 | A | | 8/1979 | Eull | 239/119 |
| 4,508,268 | A | | 4/1985 | Geberth, Jr. | |
| 4,516,724 | A | * | 5/1985 | Hellman | 239/119 |
| 4,611,758 | A | * | 9/1986 | Geberth, Jr. | 239/119 |
| 4,629,121 | A | | 12/1986 | Hengesbach | |
| 4,757,947 | A | * | 7/1988 | Calder | 239/119 |
| 5,340,029 | A | | 8/1994 | Adams | |
| 5,765,753 | A | * | 6/1998 | Kieffer | 239/119 |

FOREIGN PATENT DOCUMENTS

| | | |
|---|---|---|
| CH | 655867 | 5/1986 |
| GB | 2048123 | 12/1980 |

* cited by examiner

*Primary Examiner*—Christopher Kim
(74) *Attorney, Agent, or Firm*—Ostrolenk, Faber, Gerb & Soffen, LLP

(57) ABSTRACT

The invention concerns a spray head for high pressure spray gun comprising a rotary element located in a central body and traversed by a channel with a spray orifice and a sealing joint between the rotary element and the gun, the rotary element having in its central part a spherical shape cooperating with the joint located inside the central body and two circular seats located on either side of the spherical part supported by the seats located on either side of the body.

7 Claims, 2 Drawing Sheets

SPRAY HEAD

Figure 1:
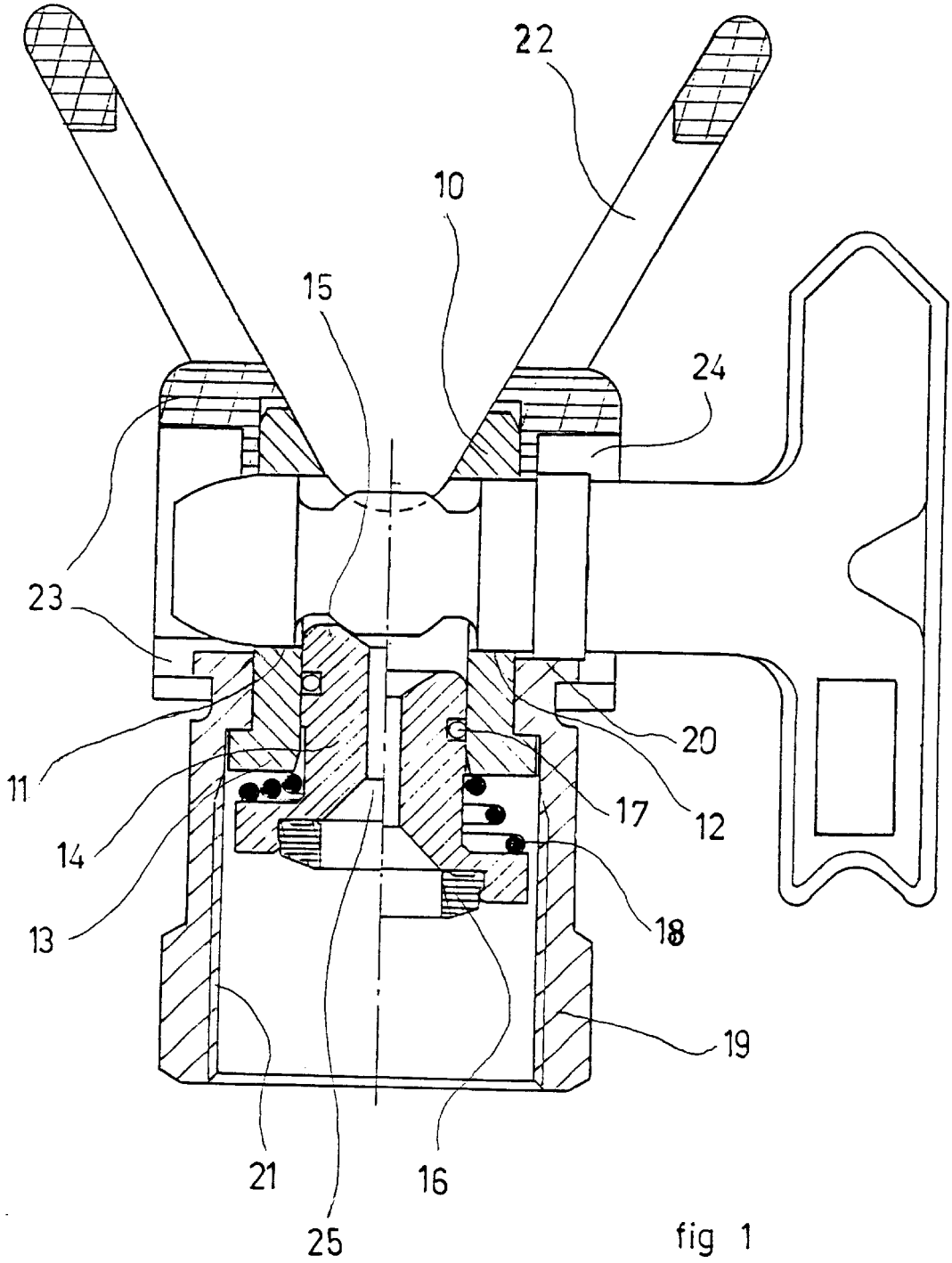

The present invention relates to a safety spray head, particularly for high-pressure spray guns comprising a rotary part positioned in a central body and containing a through channel that has a spray orifice and a seal to prevent leaks between the rotary part and the gun.

American patent U.S. Pat. No. 3,952,955 shows a spray head with a protective nozzle comprising a mechanism for alignment with the said head.

U.S. Pat. No. 3,955,763 describes a spray head for attachment to the diffuser of a spray gun, the nozzle comprising a rotary part in the form of a ball containing a spray orifice formed in a circular channel. This nozzle comprises a casing surrounding the rotary part and a sealing member positioned in the casing and applied leaktightly against the rotary part. The casing, the rotary part and the sealing member are assembled in a single operation by screwing them onto the diffuser of the spray gun. When the user wishes to change the nozzle he has to separate the nozzle from the diffuser of the gun and then assemble its various components before proceeding, in a single operation, to reassemble the nozzle on the gun diffuser. The user may experience difficulties during this operation because the nozzle components must be in the ideal position This nozzle is therefore intended to be mounted on a single type of gun and so cannot be adapted to all existing guns.

U.S. Pat. No. 4,629,121 presents a nozzle with a flow-controlling shut-off valve that comprises a frame with an inlet and an outlet on opposite sides. The controlling p art situated inside the frame can rotate on an axis perpendicular to the flow, which it intercepts.

U.S. Pat. No. 4,508,268 presents a reversible spray head for use with spray guns and devices for spraying liquids such as paints, comprising a frame, an interchangeable rotary part mounted transversely to the frame, having a bore ending in a spray opening through which the liquid passes with a shut-off part sliding in the frame that engages the rotary part and that has a passage for communication between the bore of the rotary part and the high-pressure liquid source.

Swiss patent CH 655, 867 shows us a head that already has a rotary part, this part comprising a circular groove. The central body comprises a bore and between the two it is possible to insert a seal that exhibits a cross section that adapts to this geometrical form and that allows a rotary part to be guided, positioned and maintained in its cavity inside the central body.

If the heads are not reversible it is necessary to remove their nozzles in order to clean them, whereas if they are reversible this operation is very simple and is usually done by turning a rotary part which contains it [sic]. Nonetheless, it must be remembered that nozzles have a limited life because they are used with high-pressure fluids, many of which are erosive and produce wear which modifies the geometry of the nozzle.

The life of a nozzle can be extended if manufactured from more wear resistant materials such as tungsten carbide, but even so at some stage it will still have to be replaced. As a consequence it is clear that a simple operation for dismantling this rotary part containing the nozzle in order to replace it is still desirable.

The present invention seeks to mitigate these problems and to propose a head with a rotary part of extremely simple design that makes it possible to open the passage for the fluid under pressure and to stop it. It is self-cleaning and easily detachable for changing the rotary part containing the spray nozzle. separated from the gun so that the rotary part can be extracted from the central body.

The top of the supporting seat advantageously has a concave shape so that the contact with the spherical portion of the rotary part facilitates the relative movement of one component against the other.

In a preferred embodiment, the rotary part is connected to a handle that enables it to be turned by as much as a semicircle between two extreme positions, and a lip provided on the handle and having two flat opposite surfaces abuts against the top surface of the gripping adaptor upon rotation in such a way [lacuna] the two positions are fixed.

The spray head may advantageously posses a guard around the nozzle for the protection of the user.

This configuration has the advantage that the handle can be reversed by 180°. This allows cleaning by reversing the position of the handle. Again the construction permits extremely easy dismantling of the components owing to the fact that the nut connecting the gun to the head has simply to be unscrewed in order to release the seal which is pushed via the base by the action of the spring. The rotary part can thus be withdrawn.

The drawing illustrates by way of example an embodiment of a spray head according to the invention.

Figures 2, 3:
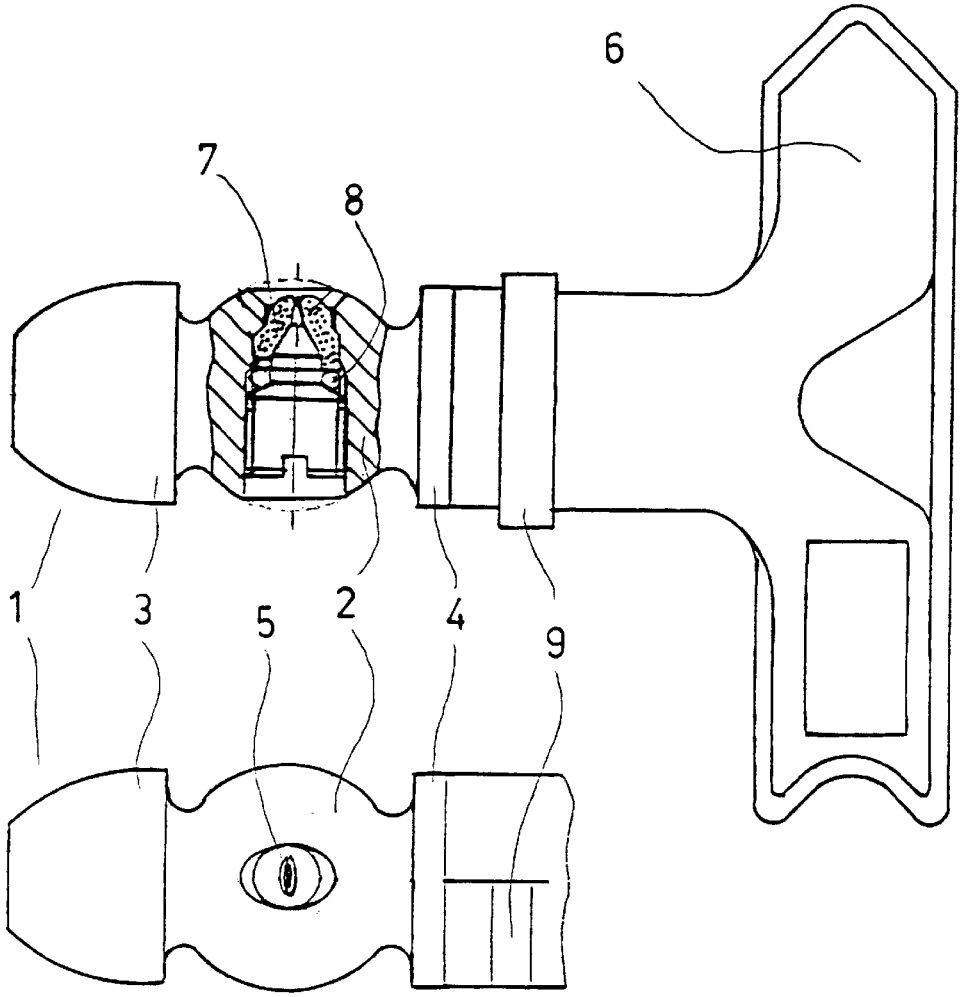

In the drawing:

FIG. 1 shows us a general view of a spray head, with a partial cross section in which on the left-hand side [lacuna] is presented in its position when screwed onto the gun and on the right-hand side when unscrewed, FIG. 2 shows a view of the rotary part with a partial cross section to show a spray nozzle, and FIG. 3 shows the same rotary part turned through 90° relative to FIG. 2, In the drawing the rotary part 1 is composed of a central spherical portion 2, and two cylindrical seats 3, 4. Inside it is a tungsten carbide spray nozzle 5 and at the extremity a handle 6 of overmoulded plastic. The tungsten carbide nozzle 5 which is inside the spherical portion 2 of the rotary part 1 is pressed into position and secured with a drilled stainless steel screw 7, with a polyamide or plastic seal 8 between the nozzle 5 and the screw 7. In the cylindrical portion of the rotary part 1, on the side closest to the handle, is a lip with two flat opposite surfaces 9. The rotary part 1 is inserted into a central body 10 at right angles to its axis. This central body 10 has two circular lateral seats 11, 12 for engagement with the equivalent circular cylindrical seats 3, 4 of the rotary part 1. Its lower end has a larger diameter that serves as a retaining lip 13. The central body 10 contains a seal 14 in the form of a supporting seat which is cylindrical and which at its upper end 15 complements the spherical shape of the central portion 2 of the rotary part. In the base it has a nylon or polyamide seal 16, and around it a stainless-steel O-ring 17 situated between the supporting seat 14 and the central body 10. A spring 18 releases the supporting seat 14 from the central body 10 when the spray head is unscrewed from the gun. Around the central body is a gripping adaptor 19 for attachment to the gun, therefore [sic] the upper part 20 is flat to engage with the bearing surfaces 9 of the rotary part. On the inside of the gripping adaptor 19 is a portion machined as a nut 21 by which it can be screwed on to the gun. A protective guard 22 is place around the nozzle 5 and has a shape 23 that encloses the central body 10, the rotary part 1 and the gripping adaptor 19. It thus has an orifice 24 through which the rotary part 1 can pass.

As soon as the spray head is fastened to the gun, the spring 18 is under pressure and the supporting seat 14 of the central body 10 is clamped against the central portion 2 of the rotary part 1. This clamping action takes advantage of the special shaping 15 of he top of the supporting seat, which has been machined mechanically to a hemisphere and adjusted by pressure against the said central portion 2 of the rotary part to provide a leaktight passage for the fluid and at the same time to allow rotation of the rotary part 1 inside the central body 10. The seals 16 and 17 will complete the job of ensuring that the pathway is leaktight. In the working position of the fluid passes through the orifice 25 of the supporting seat 14 of the central body 10, continuing through the rotary part 1 and out at the spray nozzle 5. The rotary part 1 is fixed in its working position by a bearing surface 9, on the top 20 of the gripping adaptor 19. When the rotary part is turned through half a revolution to the cleaning position, the bearing surface 9, which has two flat opposite surfaces 30, is confronted at its other side by the same top surface 20 of the gripping adaptor 19.

In all the intermediate positions of the rotary part 1, the fluid passing through the channel 25 strikes the central portion 2 of the rotary part at a place which is out of alignment with the spray nozzle 5, and the circuit is consequently closed and the fluid cannot pass through.

When the spray head is unscrewed from the gun the spring 18 pushes the supporting seat 14 away from the spherical portion 2 of the rotary part 1, so that the latter can be extracted without difficulty from the central body 10.

Both the spherical portion 2 of the rotary part 1 and the two cylindrical seats 3, 4 which are made of steel are hardened by a heat treatment and after this operation have a hardness of 55 Rockwell.

The seal or supporting seat 14 is made of a conventional stainless-steel such as an easy 3003 steel. This seal is untreated, but it undergoes a forming operation performed with the aid of the spherical portion 2 of the rotary part 1.

What is claimed is:

1. A spray head for a spray gun, comprising:

a spray head housing having a first and second end, a chamber in the housing and openings in the first and second ends communicating with the chamber;

a seal positioned in the housing and having a concave end face and a through opening for supplying fluid to a nozzle;

an opening in a side of the housing between the first and second ends and communicating with the chamber;

a nozzle holder being insertable through the side opening and having a central portion with a spherical shape and a nozzle opening for holding a nozzle;

the seal being positionable away from the central portion to permit withdrawal of the nozzle holder and being positionable in cooperation with the central portion to prevent withdrawal of the nozzle holder, with portions of the concave end face that partially surround the central portion in a direction of insertion of the nozzle holder when the seal and the central portion cooperate; and a sprint coupled to the seal to urge the concave end face of the seal out of cooperation with the spherically shaped central portion of the nozzle holder.

2. The spray head according to claim 1, further comprising a rotary bearing seat on either side of the central portion of the nozzle holder; and circular seats positioned in the housing to cooperate with the bearing seats to permit the nozzle holder to rotate about an axis.

3. The spray head according to claim 1, wherein the seal is composed of stainless steel.

4. The spray head according to claim 1, further comprising a polyamide seal on a end of the seal opposite to the concave end face.

5. The spray head according to claim 1, further comprising a groove in a lateral surface of the seal; and an O ring in the groove for preventing fluid transfer in the chamber around an outer lateral surface of the seal.

6. The spray head according to claim 2, further comprising a handle coupled to the nozzle holder to permit the nozzle holder to be turned around the axis by rotating the handle.

7. A spray head, comprising:

a housing with a first and second opening communicating with an inner chamber of the housing;

a seal movable within the housing between a first position and a second position;

a third opening in a lateral side of the housing between the first and second openings and communicating with the inner chamber of the housing;

a nozzle holder insertable in the third opening to position a nozzle in the chamber and near at least one of the first and second openings;

the seal having a concave end face and a through opening for supplying fluid to the nozzle;

the nozzle holder having a spherically shaped central portion capable of cooperating with the concave end face of the seal, such that the nozzle holder is fixed in a rotational relationship with the spray head when the seal is in a first position in which the concave end face and the spherically shaped central portion cooperates, and the nozzle holder is removable from the spray head when the seal is in the second position in which the concave end face is positioned away from the spherically shaped central portion; and a spring coupled to the seal to urge the concave end face of the seal out of cooperation with the spherically shaped central portion of the nozzle holder.

* * * * *